US009049526B2

(12) United States Patent
Higgins

(10) Patent No.: US 9,049,526 B2
(45) **Date of Patent: *Jun. 2, 2015**

(54) COMPACT PROGRAMMING BLOCK CONNECTOR FOR HEARING ASSISTANCE DEVICES

(75) Inventor: Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 12 days.

This patent is subject to a terminal disclaimer.

(21) Appl. No.: 13/422,177

(22) Filed: Mar. 16, 2012

(65) Prior Publication Data

US 2012/0263328 A1 Oct. 18, 2012

Related U.S. Application Data

(60) Provisional application No. 61/454,518, filed on Mar. 19, 2011.

(51) Int. Cl.
*H04R 25/00* (2006.01)

(52) U.S. Cl.
CPC ..... *H04R 25/556* (2013.01); *H04R 25/70* (2013.01)

(58) Field of Classification Search
USPC ..... 381/323, 314, 322, 330
See application file for complete search history.

(56) References Cited

U.S. PATENT DOCUMENTS 2,327,320 A 8/1943 Shapiro
3,728,509 A 4/1973 Shimojo
3,812,300 A 5/1974 Brander et al.
4,017,834 A 4/1977 Cuttill et al.
4,310,213 A 1/1982 Fetterolf, Sr. et al.
4,564,955 A * 1/1986 Birch et al. ..... 381/330

(Continued)

FOREIGN PATENT DOCUMENTS

DE 3006235 A1 10/1980
DE 3643124 A1 7/1988

(Continued)

OTHER PUBLICATIONS

"U.S. Appl. No. 11/857,439, Notice of Allowance mailed May 30, 2012", 9 pgs.

(Continued)

*Primary Examiner* — Davetta W. Goins
*Assistant Examiner* — Amir Etesam
(74) *Attorney, Agent, or Firm* — Schwegman Lundberg & Woessner, P.A.

(57) ABSTRACT

The present subject matter relates to a method and apparatus for a compact programming block for a hearing assistance device, such as a hearing aid. In one embodiment, the compact programming block is formed in a programming block module with another component and the programming block module includes a flexible circuit design. The design incorporates a first flexible circuit disposed in a programming module that receives a second flexible circuit connection. The programming block module includes a plurality of contact springs and is shaped to provide a small profile that is integrated with a microphone housing. The integrated microphone and programming block module can be used in a hearing assistance device. In various embodiments, the programming block is integrated with a pushbutton, and the integrated pushbutton and programming block can be used in a hearing assistance device.

20 Claims, 3 Drawing Sheets

(56) References Cited

U.S. PATENT DOCUMENTS

| | | | | |
|---|---|---|---|---|
| 4,571,464 | A | 2/1986 | Segero | |
| 4,729,166 | A | 3/1988 | Lee et al. | |
| 5,606,621 | A | 2/1997 | Reiter et al. | |
| 5,687,242 | A | 11/1997 | Iburg | |
| 5,708,720 | A | 1/1998 | Meyer | |
| 5,755,743 | A | 5/1998 | Volz et al. | |
| 5,802,183 | A * | 9/1998 | Scheller et al. | 381/322 |
| 5,824,968 | A | 10/1998 | Packard et al. | |
| 5,825,894 | A | 10/1998 | Shennib | |
| 5,987,146 | A | 11/1999 | Pluvinage et al. | |
| 6,031,923 | A | 2/2000 | Gnecco et al. | |
| 6,167,138 | A | 12/2000 | Shennib | |
| 6,766,030 | B1 | 7/2004 | Chojar | |
| 6,876,074 | B2 | 4/2005 | Kim | |
| 7,016,512 | B1 | 3/2006 | Freeley et al. | |
| 7,110,562 | B1 | 9/2006 | Feeley et al. | |
| 7,139,404 | B2 | 11/2006 | Feeley et al. | |
| 7,142,682 | B2 | 11/2006 | Mullenborn et al. | |
| 7,256,747 | B2 | 8/2007 | Victorian et al. | |
| 7,320,832 | B2 | 1/2008 | Palumbo et al. | |
| 7,354,354 | B2 | 4/2008 | Palumbo et al. | |
| 7,446,720 | B2 | 11/2008 | Victorian et al. | |
| 7,471,182 | B2 | 12/2008 | Kumano et al. | |
| 7,593,538 | B2 | 9/2009 | Polinske | |
| 8,098,863 | B2 | 1/2012 | Ho et al. | |
| 8,116,495 | B2 | 2/2012 | Spaulding | |
| 8,295,517 | B2 | 10/2012 | Gottschalk et al. | |
| 8,385,573 | B2 | 2/2013 | Higgins | |
| 8,494,195 | B2 | 7/2013 | Higgins | |
| 8,638,965 | B2 | 1/2014 | Higgins et al. | |
| 8,705,785 | B2 | 4/2014 | Link et al. | |
| 8,781,141 | B2 | 7/2014 | Higgins et al. | |
| 8,798,299 | B1 | 8/2014 | Higgins et al. | |
| 8,861,761 | B2 | 10/2014 | Higgins | |
| 2002/0131614 | A1 * | 9/2002 | Jakob et al. | 381/314 |
| 2003/0178247 | A1 | 9/2003 | Saltykov | |
| 2003/0200820 | A1 | 10/2003 | Takada et al. | |
| 2004/0010181 | A1 | 1/2004 | Feeley et al. | |
| 2004/0114776 | A1 | 6/2004 | Crawford et al. | |
| 2004/0240693 | A1 | 12/2004 | Rosenthal | |
| 2005/0008178 | A1 | 1/2005 | Joergensen et al. | |
| 2005/0111685 | A1 * | 5/2005 | Gabathuler | 381/322 |
| 2006/0097376 | A1 | 5/2006 | Leurs et al. | |
| 2006/0159298 | A1 | 7/2006 | Von Dombrowski et al. | |
| 2007/0009130 | A1 | 1/2007 | Feeley et al. | |
| 2007/0036374 | A1 | 2/2007 | Bauman et al. | |
| 2007/0121979 | A1 | 5/2007 | Zhu et al. | |
| 2007/0147630 | A1 * | 6/2007 | Chiloyan | 381/74 |
| 2007/0188289 | A1 | 8/2007 | Kumano et al. | |
| 2007/0248234 | A1 * | 10/2007 | Ho et al. | 381/87 |
| 2008/0003736 | A1 | 1/2008 | Arai et al. | |
| 2008/0026220 | A9 | 1/2008 | Bi et al. | |
| 2008/0187157 | A1 | 8/2008 | Higgins | |
| 2008/0199971 | A1 | 8/2008 | Tondra | |
| 2008/0260193 | A1 | 10/2008 | Westermann et al. | |
| 2009/0074218 | A1 * | 3/2009 | Higgins | 381/323 |
| 2009/0075083 | A1 | 3/2009 | Bi et al. | |
| 2009/0196444 | A1 | 8/2009 | Solum | |
| 2009/0245558 | A1 | 10/2009 | Spaulding | |
| 2009/0252365 | A1 * | 10/2009 | Lin | 381/369 |
| 2009/0262964 | A1 | 10/2009 | Havenith et al. | |
| 2010/0034410 | A1 | 2/2010 | Link et al. | |
| 2010/0074461 | A1 | 3/2010 | Polinske | |
| 2010/0124346 | A1 | 5/2010 | Higgins | |
| 2010/0158291 | A1 | 6/2010 | Polinske et al. | |
| 2010/0158293 | A1 | 6/2010 | Polinske et al. | |
| 2010/0158295 | A1 | 6/2010 | Polinske et al. | |
| 2012/0014549 | A1 | 1/2012 | Higgins et al. | |
| 2013/0230197 | A1 | 9/2013 | Higgins | |
| 2014/0355803 | A1 | 12/2014 | Higgins et al. | |

FOREIGN PATENT DOCUMENTS

| | | | |
|---|---|---|---|
| DE | 4005476 | A1 | 7/1991 |
| DE | 9320391 | U1 | 9/1993 |
| DE | 4233813 | C1 | 11/1993 |
| DE | 29801567 | U1 | 5/1998 |
| EP | 0339877 | A3 | 11/1989 |
| EP | 0866637 | A2 | 9/1998 |
| EP | 1065863 | A2 | 1/2001 |
| EP | 1465457 | A2 | 10/2004 |
| EP | 1496530 | A2 | 1/2005 |
| EP | 1811808 | A1 | 7/2007 |
| EP | 1816893 | A1 | 8/2007 |
| EP | 2040343 | A1 | 3/2009 |
| GB | 1298089 | | 11/1972 |
| GB | 1522549 | | 8/1978 |
| JP | 2209967 | A | 8/1990 |
| JP | 2288116 | A | 11/1990 |
| JP | 09199662 | A | 7/1997 |
| WO | WO-2004025990 | A1 | 3/2004 |
| WO | WO-2006094502 | A1 | 9/2006 |
| WO | WO-2007148154 | A1 | 12/2007 |
| WO | WO-2008092265 | A1 | 8/2008 |
| WO | WO-2008097600 | A1 | 8/2008 |
| WO | WO-2008097600 | C1 | 8/2008 |
| WO | WO-2011101041 | A1 | 8/2011 |

OTHER PUBLICATIONS

"U.S. Appl. No. 11/857,439, Notice of Allowance mailed Sep. 19, 2012", 9 pgs.
"U.S. Appl. No. 12/027,173, Non Final Office Action mailed Jul. 27, 2012", 11 pgs.
"U.S. Appl. No. 12/027,173, Notice of Allowance mailed Mar. 19, 2013", 8 pgs.
"U.S. Appl. No. 12/027,173, Response filed Jun. 8, 2012 to Final Office Action mailed Dec. 8, 2011", 7 pgs.
"U.S. Appl. No. 12/027,173, Response filed Dec. 26, 2012 to Non Final Office Action mailed Jul. 27, 2012", 8 pgs.
"U.S. Appl. No. 12/539,195, Advisory Action mailed Apr. 23, 2013", 3 pgs.
"U.S. Appl. No. 12/539,195, Final Office Action mailed Feb. 11, 2013", 15 pgs.
"U.S. Appl. No. 12/539,195, Non Final Office Action mailed Jul. 20, 2012", 13 pgs.
"U.S. Appl. No. 12/539,195, Response filed Apr. 11, 2013 to Final Office Action mailed Feb. 11, 2013", 7 pgs.
"U.S. Appl. No. 12/539,195, Response filed Dec. 20, 2012 to Non Final Office Action mailed Jul. 20, 2012", 7 pgs.
"U.S. Appl. No. 12/548,051, Non Final Office Action mailed Jan. 24, 2013", 12 pgs.
"U.S. Appl. No. 12/548,051, Response filed Apr. 24, 2013 to Non Final Office Action mailed Jan. 24, 2013", 8 pgs.
"U.S. Appl. No. 12/548,051, Response filed Sep. 19, 2012 to Final Office Action mailed Apr. 19, 2012", 8 pgs.
"U.S. Appl. No. 12/644,188 , Response filed Feb. 19, 2013 to Non Final Office Action mailed Sep. 19, 2012", 6 pgs.
"U.S. Appl. No. 12/644,188, Final Office Action mailed May 22, 2013", 7 pgs.
"U.S. Appl. No. 12/644,188, Non Final Office Action mailed Sep. 19, 2012", 8 pgs.
"U.S. Appl. No. 13/181,752 , Response filed Jun. 5, 2013 to Non Final Office Action mailed Mar. 5, 2013", 8 pgs.
"U.S. Appl. No. 13/181,752, Non Final Office Action mailed Mar. 5, 2013", 7 pgs.
"U.S. Appl. No. 11/857,439 , Response filed Dec. 17, 2011 to Non Final Office Action mailed Aug. 17, 2011", 12 pgs.
"U.S. Appl. No. 11/857,439, Final Office Action mailed Feb. 29, 2012", 16 pgs.
"U.S. Appl. No. 11/857,439, Non Final Office Action mailed Aug. 17, 2011", 16 pgs.
"U.S. Appl. No. 11/857,439, Response filed Apr. 30, 2012 to Final Office Action mailed Feb. 29, 2012", 9 pgs.
"U.S. Appl. No. 11/857,439, Response filed Jun. 13, 2011 to Restriction Requirement mailed May 11, 2011", 8 pgs.

(56) References Cited

OTHER PUBLICATIONS

"U.S. Appl. No. 11/857,439, Restriction Requirement Action mailed May 11, 2011", 6 pgs.
"U.S. Appl. No. 12/027,173, Final Office Action mailed Dec. 8, 2011", 12 pgs.
"U.S. Appl. No. 12/027,173, Non Final Office Action mailed Jul. 11, 2011", 10 pgs.
"U.S. Appl. No. 12/027,173, Response filed Nov. 14, 2011 to Non Final Office Action mailed Jul. 11, 2011", 8 pgs.
"U.S. Appl. No. 12/059,578, Notice of Allowance mailed Oct. 5, 2011", 8 pgs.
"U.S. Appl. No. 12/548,051, Non Final Office Action mailed Oct. 12, 2011", 11 pgs.
"U.S. Appl. No. 12/548,051, Response filed Jan. 12, 2012 to Non Final Office Action mailed Oct. 12, 2011", 9 pgs.
"U.S. Appl. No. 12/548,051,Final Office Action mailed Apr. 19, 2012", 12 pgs.
"European Application Serial No. 08253065.0, European Examination Notification mailed Oct. 11, 2011", 7 pgs.
"European Application Serial No. 08253065.0, European Office Action mailed Aug. 26, 2010", 6 Pgs.
"European Application Serial No. 08253065.0, Extended Search Report Mailed Dec. 15, 2008", 9 pgs.
"European Application Serial No. 08253065.0, Office Action mailed Jul. 17, 2009", 1 pg.
"European Application Serial No. 08253065.0, Response filed Jan. 26, 2010 to Office Action mailed Jul. 17, 2009", 9 pgs.
"European Application Serial No. 08253065.0, Response filed Feb. 8, 2012 to Examination Notification mailed Oct. 11, 2011", 15 pgs.
"European Application Serial No. 08253065.0, Response to Office Action filed Feb. 28, 2011 to European Office Action mailed Aug. 26, 2010", 17 pgs.
"European Application Serial No. 08725262.3, Office Action mailed Apr. 21, 2010", 6 Pgs.
"European Application Serial No. 08725262.3, Office Action mailed Aug. 5, 2011", 5 pgs.
"European Application Serial No. 08725262.3, Office Action Response Filed Nov. 2, 2010", 14 pgs.
"European Application Serial No. 08725262.3, Response filed Feb. 13, 2012 to Office Action mailed Aug. 5, 2011", 11 pgs.
"European Application Serial No. 09168844.0, European Search Report mailed Apr. 19, 2010", 3 Pgs.
"European Application Serial No. 09168844.0, Office Action mailed Apr. 28, 2011", 5 pgs.
"European Application Serial No. 09168844.0, Office Action mailed May 3, 2010", 5 pgs.
"European Application Serial No. 09168844.0, Office Action Response Filed: Nov. 15, 2010", 8 pgs.
"European Application Serial No. 09250729.2, Extended Search Report Mailed Dec. 14, 2009", 4 pgs.
"International Application Serial No. PCT/US2008/001609, International Preliminary Report on Patentability mailed Aug. 20, 2009", 10 pgs.
"International Application Serial No. PCT/US2008/001609, Search Report mailed Jun. 19, 2008", 7 pgs.
"International Application Serial No. PCT/US2008/001609, Written Opinion mailed Jun. 19, 2008", 8 pgs.
Buchoff, L S, "Advanced Non-Soldering Interconnection", Electro International, 1991 (IEEE), XP 10305250A1, (1991), 248-251.
Tondra, Mark, "Flow Assay With Integrated Detector", U.S. Provisional Application U.S. Appl. No. 60/887,609, filed Feb. 1, 2007, 28 pgs.
"U.S. Appl. No. 12/539,195, Non Final Office Action mailed Aug. 2, 2013", 14 pgs.
"U.S. Appl. No. 12/539,195, Notice of Allowance mailed Nov. 29, 2013", 12 pgs.
"U.S. Appl. No. 12/539,195, Response filed Nov. 4, 2013 to Non Final Office Action mailed Aug. 2, 2013", 7 pgs.
"U.S. Appl. No. 12/548,051, Notice of Allowance mailed Jul. 31, 2013", 14 pgs.
"U.S. Appl. No. 12/644,188, Advisory Action mailed Jul. 25, 2013", 3 pgs.
"U.S. Appl. No. 12/644,188, Non Final Office Action mailed Sep. 9, 2013", 9 pgs.
"U.S. Appl. No. 12/644,188, Response filed Jul. 22, 2013 to Final Office Action mailed May 22, 2013", 6 pgs.
"U.S. Appl. No. 12/644,188, Response filed Dec. 9, 2013 to Non Final Office Action mailed Sep. 9, 2013", 6 pgs.
"U.S. Appl. No. 13/181,752, Final Office Action mailed Jul. 11, 2013", 7 pgs.
"U.S. Appl. No. 13/181,752, Notice of Allowance mailed Sep. 25, 2013", 9 pgs.
"U.S. Appl. No. 13/181,752, Response filed Sep. 11, 2013 to Final Office Action mailed Jul. 11, 2013", 8 pgs.
"U.S. Appl. No. 13/776,557, Non Final Office Action mailed Oct. 22, 2013", 6 pgs.
"U.S. Appl. No. 12/644,188, Notice of Allowance mailed Mar. 21, 2014", 5 pgs.
"U.S. Appl. No. 13/776,557, Final Office Action mailed Mar. 20, 2014", 8 pgs.
"U.S. Appl. No. 13/776,557, Notice of Allowance mailed Jun. 13, 2014", 8 pgs.
"U.S. Appl. No. 13/776,557, Response filed Jan. 22, 2014 to Non Final Office Action mailed Oct. 22, 2013", 6 pgs.
"U.S. Appl. No. 13/776,557, Response filed May 15, 2014 to Final Office Action mailed Mar. 20, 2014", 7 pgs.
"U.S. Appl. No. 14/301,103, Preliminary Amendment Filed Jul. 1, 2014", 5 pgs.

* cited by examiner

COMPACT PROGRAMMING BLOCK CONNECTOR FOR HEARING ASSISTANCE DEVICES

CLAIM OF PRIORITY AND INCORPORATION BY REFERENCE

The present application claims the benefit of U.S. Provisional Patent Application 61/454,518, filed Mar. 19, 2011, entitled "COMPACT PROGRAMMING BLOCK CONNECTOR FOR HEARING ASSISTANCE DEVICES," the disclosure of which is hereby incorporated by reference in its entirety.

TECHNICAL FIELD

This document relates generally to hearing assistance devices and more particularly to a programming block connector for hearing assistance devices.

BACKGROUND

Hearing assistance devices, such as hearing aids, will often use direct connections for programming the device. Direct connections require some form of connector on the hearing assistance device. However, such connectors may require a substantial amount of space and increase the overall volume of the device. Such connectors may not provide easy and robust connections. Thus, there is a need in the art for improved, compact connections for hearing assistance devices.

SUMMARY

Method and apparatus for a compact programming block for a hearing assistance device, such as a hearing aid. In one embodiment, the compact programming block is formed in a programming block module with another component. In various embodiments the programming block module includes a flexible circuit design. In various embodiments, the design incorporates a first flexible circuit disposed in a programming module that receives a second flexible circuit connection. In various embodiments, the programming block module includes a plurality of contact springs. In various embodiments, the programming block module is shaped to provide a small profile that is integrated with a microphone housing. In such embodiments, the integrated microphone and programming block module can be used in a hearing assistance device. In various embodiments, the programming block is integrated with a pushbutton. In such embodiments, the integrated pushbutton and programming block can be used in a hearing assistance device. Combinations of these various aspects can be provided according to various embodiments of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Method and apparatus for a compact programming block for a hearing assistance device, such as a hearing aid. In one embodiment, the compact programming block is formed in a programming block module with another component. In various embodiments the programming block module includes a flexible circuit design. In various embodiments, the design incorporates a first flexible circuit disposed in a programming module that receives a second flexible circuit connection. In various embodiments, the programming block module includes a plurality of contact springs. In various embodiments, the programming block module is shaped to provide a small profile that is integrated with a microphone housing. In such embodiments, the integrated microphone and programming block module can be used in a hearing assistance device. In various embodiments, the programming block is integrated with a pushbutton. In such embodiments, the integrated pushbutton and programming block can be used in a hearing assistance device. Combinations of these various aspects can be provided according to various embodiments of the present subject matter.

Figure 1:
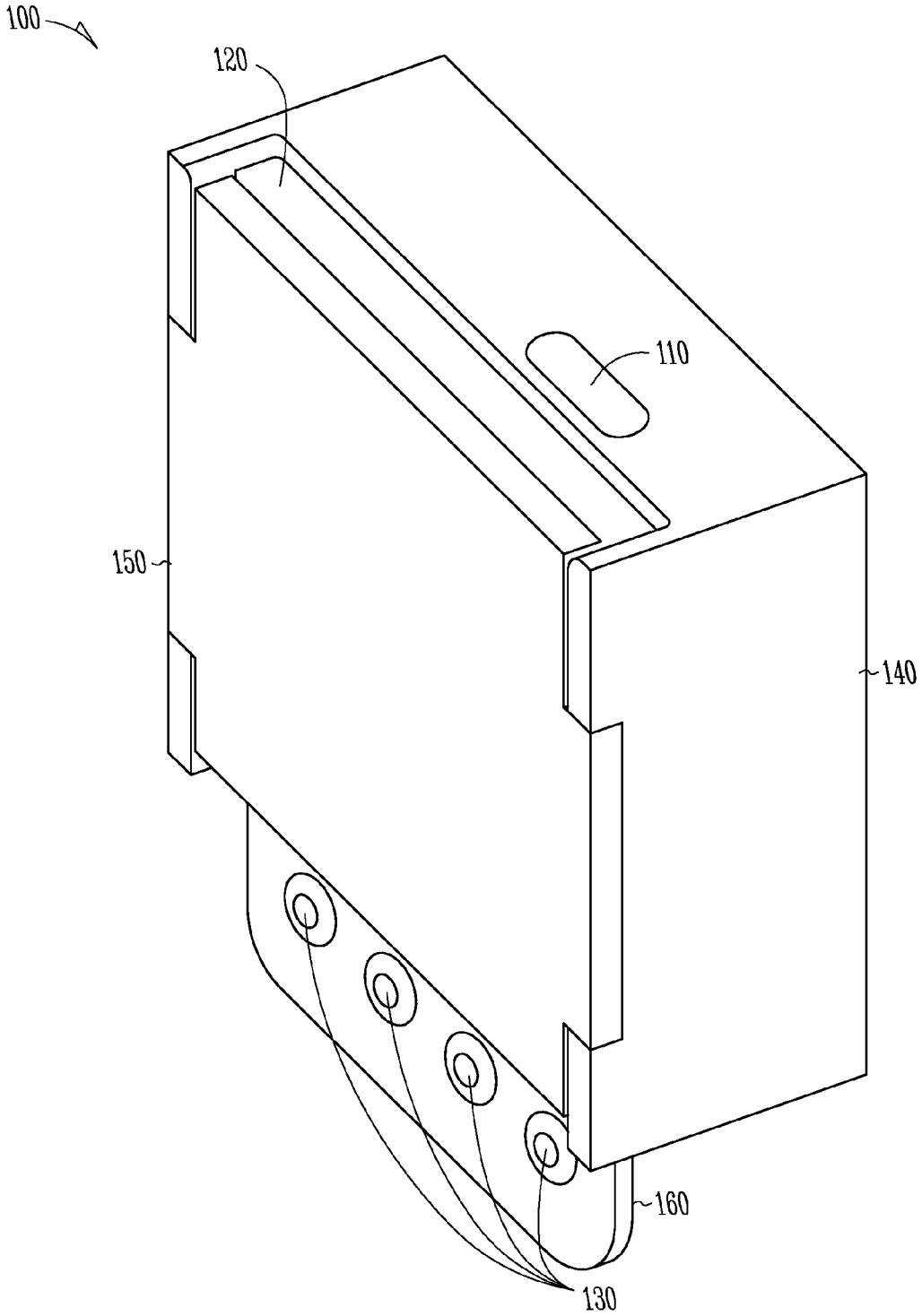
FIG. 1 is a perspective view of a module with integrated programming block and microphone, according to one embodiment of the present subject matter.

FIG. 1 is a perspective view of a module 100 with integrated programming block and microphone, according to one embodiment of the present subject matter. FIG. 1 shows a main housing 140 that connects to a cover 150 to enclose the microphone (not shown) and the connector assembly using flexible circuit 160. In various embodiments, the main housing 140 includes a hole 110 for sound to reach the microphone. In various embodiments the housing 140 and cover 150 form a slit opening 120 to receive a tape connector (not shown) for the programming connection. It is understood that other shapes for connection can be used without departing from the scope of the present subject matter. Thus, slit opening 120 can be in different configurations for different connectors.

In various embodiments, the flexible circuit 160 has contacts 130 for connections to the programming connector. The housing has microphone connections that are more visible in FIG. 2. In various embodiments, the main housing is a welded frame. Different main housing materials may be used to provide a rigid module housing. In various embodiments, the main housing is made out of metal. In various embodiments, the main housing is made out of an electrically insulating material. In various embodiments, the housing is a 0.2 mm frame. In various embodiments the frame is a laser welded frame. In various embodiments, the cover 150 is made of a conductive material. In one embodiment, the cover 150 is an electrically insulating material. In various embodiments, the cover 150 is made out of FR4. Other sizes and materials and assemblies may be used without departing from the scope of the present subject matter.

Figure 2:
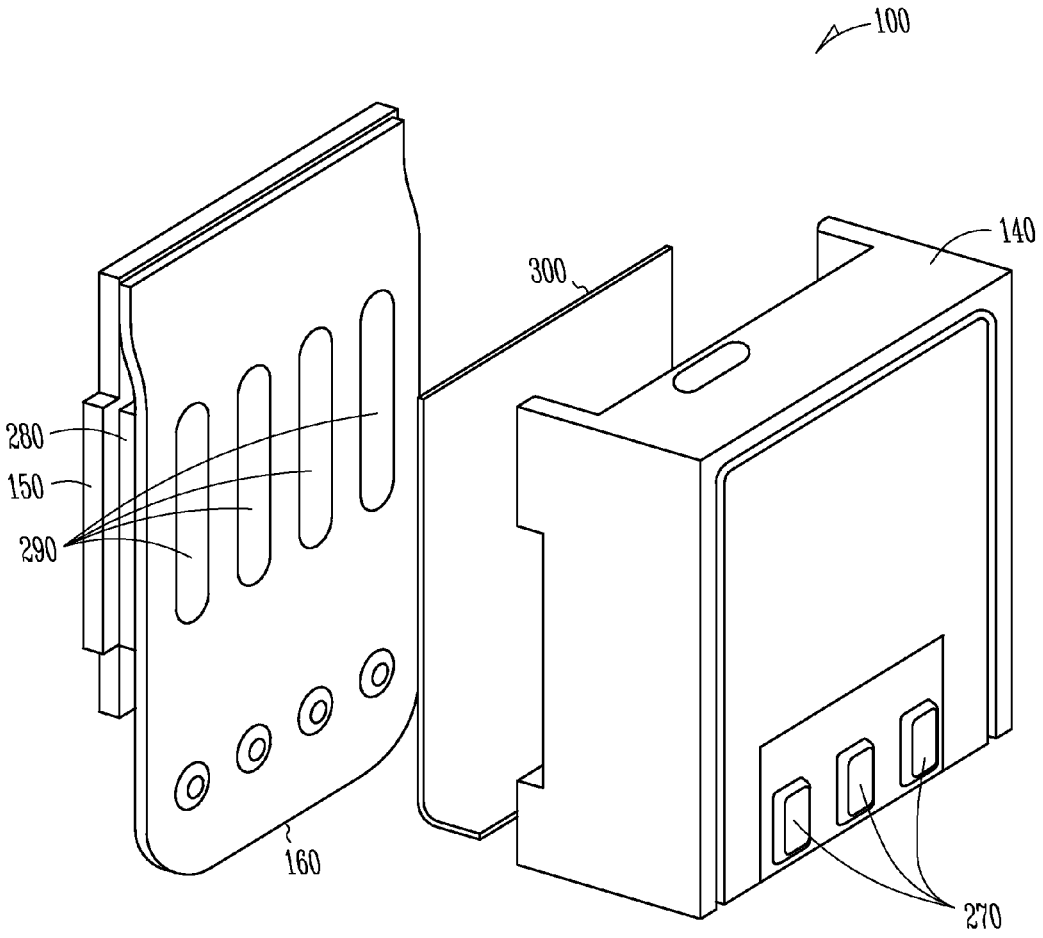
FIG. 2 is an exploded view of the module of FIG. 1, according to one embodiment of the present subject matter.

FIG. 2 is an exploded view of the module 100 of FIG. 1, according to one embodiment of the present subject matter. This exploded view shows one embodiment where an elastomeric pad 280 is sandwiched between the cover 150 and flexible circuit 160 to urge connector contacts 290 slightly outward to provide a better connection with a flexible tape connector (not shown) as it is inserted. A flexible tape connector inserted into slit 120 will contact the plurality of contacts 290 as it is inserted between the flexible circuit 160 and bias element 300. The bias element provides a plane for contacts between a flexible tape connector (not shown) and the flexible circuit 160. Thus, the opening is ramped using the elastomeric pad to make more robust connections. In various embodiments, bias element 300 is optional and can be omitted provided that the geometries of the microphone inserted into the main housing 140 can provide a suitable surface to bias against a connector inserted into slit 120. Other variations and component configurations are possible without departing from the scope of the present subject matter.

In various embodiments the main housing 140 is metallic. In such embodiments, a number of insulated contact feedthroughs can be used to provide signal and power contacts 270 for the component or components in the module (for example, a microphone). In the embodiment shown in FIG. 2 a plurality of microphone connections 270 are provided for electrical connections with the microphone (not shown) that is enclosed in the main housing 140 when assembled.

Figure 3:
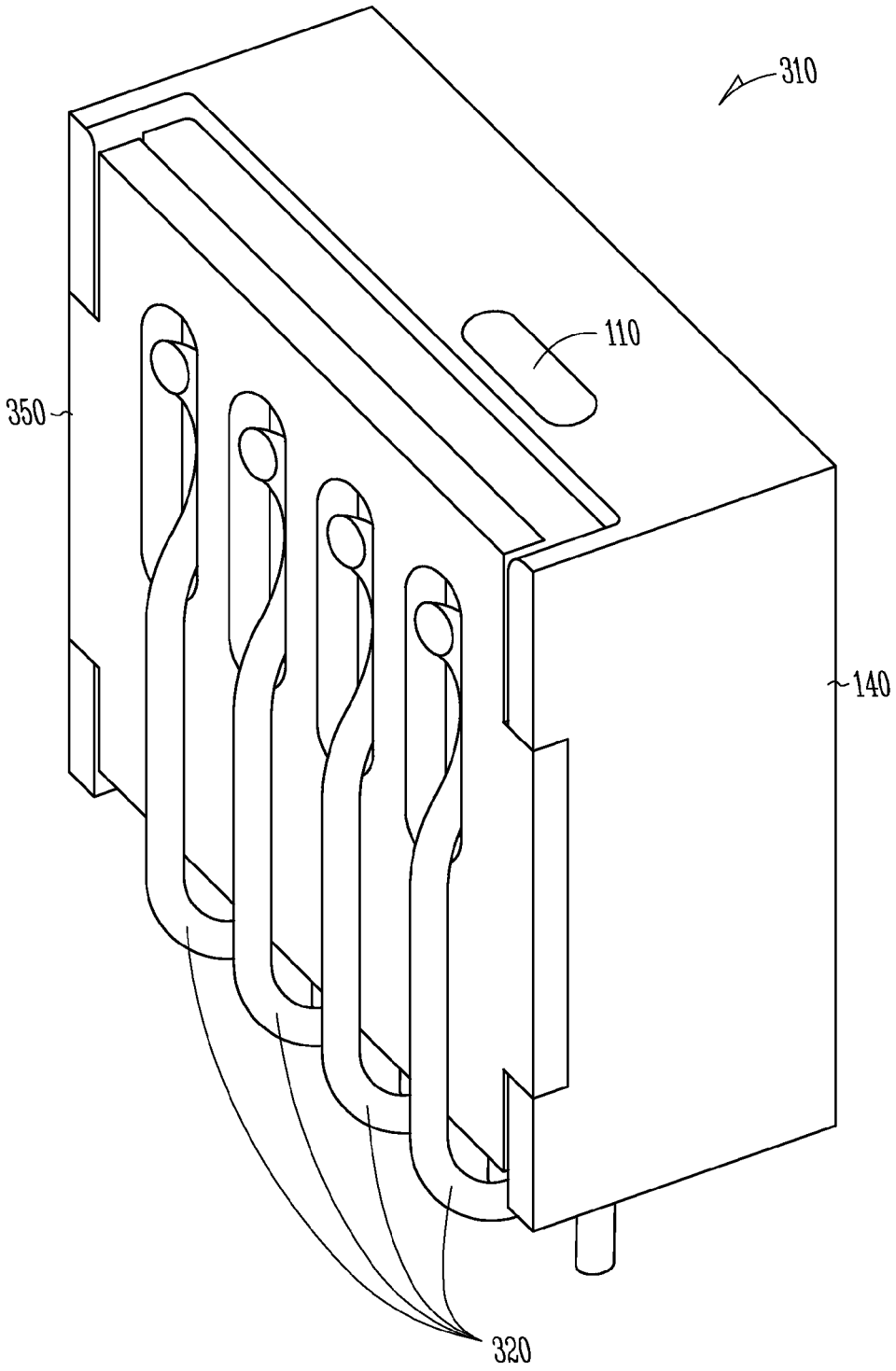
FIG. 3 is a perspective view of a module with integrated programming block and microphone using spring contacts, according to one embodiment of the present subject matter.

FIG. 3 is a perspective view of a module 310 with integrated programming block and microphone using spring contacts 320, according to one embodiment of the present subject matter. The cover 350 has openings to accommodate the spring contacts 320 and provide freedom of movement of the spring contacts 320. The design can be made similar to that of FIG. 2, and does not require a flexible circuit 160 for its design. In various embodiments, the spring contacts 320 can extend towards the bottom of FIG. 3 to provide contacts for electrical connections for the programming connector.

The present programming block can be integrated with other components. In various embodiments, a pushbutton is integrated with the programming block as a module. In such embodiments, the module includes the programming block and the pushbutton. Other components can be integrated with the programming block. In various embodiments it is advantageous to combine the programming block with other devices such that the increase in size and volume for the combined module is relatively small. For example, with one microphone and programming block combination, the added dimensions arising from integrating the programming block over a microphone dimension is about 0.4 mm of width and 1.4 mm of thickness added to the microphone dimensions. That is a relatively modest increase in volume and very efficient over other programming blocks which can add over twice that amount of size and/or volume.

Although various embodiments demonstrate the present programming module with 4 programming connections and 3 microphone connections, it is understood that the actual amount of connections may vary without departing from the present subject matter. The actual connections may vary with different components and with different signal and power lines to handle. Furthermore, even though the present subject matter is described in light of a programming connection, it is understood that the present subject matter can be used for other purposes, including, but not limited to, streaming audio, two way communications, and diagnostic purposes.

In various embodiments the programming block is adapted to receive a pushbutton module. In various embodiments, a removable pushbutton module approach provides a programming block that is adapted to receive the removable pushbutton module for pushbutton operation. When the pushbutton module is removed, a snap in programming cable can be placed into the vacant connector block that had previously accommodated the pushbutton module. Thus, with the pushbutton module removed, the vacancy is the programming connector block. When programming is complete, the programming cable is removed and the pushbutton module is inserted. In various embodiments, the leads of the programming connector can be used for the pushbutton function. Some designs may short multiple leads to provide a switching function. When the switch is depressed, it shorts leads which are sensed by the electronics of the device for the pushbutton function.

Some benefits include increased savings in volume of such devices, reduced touch points, reduced part count, and stronger shell designs for devices.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A module for a hearing assistance device adapted to be worn on or in an ear of a user, the module comprising:

a housing of the module configured to accommodate a microphone and a programming connector, the housing configured to provide external electrical contacts to the microphone and the programming connector, the housing configured to be inserted into a device housing of the hearing assistance device; and a removable cover for the housing of the module, the cover and housing configured to define an opening when the cover is affixed to the housing, the opening configured to receive a flexible programming tape, and wherein the programming connector is configured to connect to the flexible programming tape using a flexible circuit that mates with the flexible programming tape when inserted into the opening.

2. The module of claim 1, wherein the cover includes a conductive material.

3. The module of claim 2, wherein the housing and cover form a slit opening configured to receive the flexible programming tape.

4. The module of claim 2, further comprising an elastomeric pad between the cover and the flexible circuit, the pad configured to improve the connection between the flexible circuit and the flexible programming tape.

5. The module of claim 1, further comprising a bias element configured to provide a plane for contacts between the flexible circuit and the flexible programming tape.

6. The module of claim 1, further comprising a plurality of contact springs external to the housing.

7. The module of claim 1, further comprising a pushbutton module.

8. The module of claim 7, wherein the housing is configured to removably receive the pushbutton module.

9. The module of claim 1, wherein the housing includes a metal material.

10. The module of claim 1, wherein the housing includes a welded frame.

11. The module of claim 1, wherein the housing includes an electrically insulating material.

12. A method for a compact programming block for a hearing assistance device adapted to be worn on or in an ear of a user, the method comprising:

providing a housing of the programming block configured to accommodate a microphone and a programming connector, the housing configured to be inserted into a device housing of the hearing assistance device;

configuring the housing to provide external electrical contacts to the microphone and the programming connector;

providing a removable cover for the housing, the cover and housing configured to define an opening when the cover is affixed to the housing, the opening configured to receive a flexible programming tape; and configuring the programming connector to connect to the flexible programming tape using a flexible circuit that mates with the flexible programming tape when inserted into the opening.

13. The method of claim 12, further comprising receiving data from the flexible programming tape for using in the hearing assistance device.

14. The method of claim 13, wherein receiving data includes receiving data to program the hearing assistance device.

15. The method of claim 13, wherein receiving data includes receiving streaming audio.

16. The method of claim 12, wherein the hearing assistance device includes a hearing aid.

17. The method of claim 16, wherein the hearing aid includes a behind-the-ear (BTE) hearing aid.

18. The method of claim 16, wherein the hearing aid includes an in-the-ear (ITE) hearing aid.

19. The method of claim 16, wherein the hearing aid includes a receiver-in-canal (RIC) hearing aid.

20. The method of claim 16, wherein the hearing aid includes a completely-in-the-canal (CIC) hearing aid.

* * * * *